US005496463A

United States Patent [19]

Mori et al.

[11] Patent Number: 5,496,463

[45] Date of Patent: Mar. 5, 1996

[54] PROCESS AND APPARATUS FOR COMPOSITE ELECTROPLATING A METALLIC MATERIAL

[75] Inventors: Seiki Mori; Yasutoshi Ohtoh; Masaaki Beppu, all of Tokyo, Japan

[73] Assignee: Nihon Parkerizing Co., Ltd., Tokyo, Japan

[21] Appl. No.: 350,449

[22] Filed: Dec. 7, 1994

[30] Foreign Application Priority Data

Dec. 8, 1993 [JP] Japan ..... 5-308201

[51] Int. Cl.[6] ..... C25D 15/00

[52] U.S. Cl. ..... 205/109; 205/110; 205/148; 205/151; 205/238; 204/275; 204/284

[58] Field of Search ..... 205/109, 110, 205/148, 151, 238; 204/275, 284

[56] References Cited

FOREIGN PATENT DOCUMENTS 51-50825 5/1976 Japan .

52-93636 8/1977 Japan .

555973 9/1943 United Kingdom .

*Primary Examiner*—John Niebling

*Assistant Examiner*—Edna Wong

*Attorney, Agent, or Firm*—Cushman Darby & Cushman

[57] ABSTRACT

In an electroplating container in which at least one portion of an inside surface of the container is formed from a metal material serving as cathode or anode and an anode or cathode is placed in the container, a composite electroplating liquid containing metal ions and fine solid particles is introduced into a bottom portion of the container in such a manner that the introduced composite electroplating liquid spouts downward against an inside bottom surface of the container and is allowed to flow upward through a flow path formed between the anode and the cathode, and an electric current is applied between the anode and cathode so as to form a composite electroplating layer including the fine solid particles evenly distributed in a metal matrix on a surface of the cathode or anode facing the flow path.

13 Claims, 4 Drawing Sheets

PROCESS AND APPARATUS FOR COMPOSITE ELECTROPLATING A METALLIC MATERIAL

BACKGROUND OF THE INVENTION

1. Field of the Invention

The present invention relates to a process and apparatus for composite electroplating a metallic materials. More particularly, the present invention relates to a process and apparatus for composite electroplating a surface of a metallic material with a plating liquid containing metal ions and fine solid particles.

2. Description of the Related Art

In a conventional composite electroplating process, it is well known that a composite electroplating liquid bath is prepared by dispersing fine solid particles in an electroplating liquid containing metal ions, and a metal material is immersed in the composite electroplating liquid bath, while fully stirring the composite electroplating liquid by a propeller-stirring method, pump-circulating method or air-stirring method so as to evenly disperse the fine solid particles in the electroplating liquid. This composite process is disadvantageous for the following reasons.

(1) When the propeller-stirring method is applied, the composite electroplating liquid flows in one direction to form a parallel flow, and thus it is difficult to cause the fine solid particles to be uniformly distributed in the composite electroplating liquid. Where this method is applied to electroplate, for example, an inside peripheral surface of a cylinder, a portion of the composite electroplating liquid brought into contact with the inside peripheral surface of the cylinder flows at a reduced flow speed, and thus the resultant composite plating layer formed on the inside peripheral surface of the cylinder has an uneven surface. Also, it is difficult to uniformly distribute the fine solid particles in the resultant composite electroplating layer.

(2) When the pump-circulating method is applied, the same problems as that of the propeller-stirring method occur.

(3) When the air-stirring method is applied, a plurality of air-blowing pipes (nozzles) are connected to a vessel containing the composite electroplating liquid. In this apparatus, it is difficult to control the air-blowing operation so that air is blown uniformly into the composite electroplating liquid through all the pipes. Therefore, it is difficult to maintain the fine solid particles in a uniformly distributed condition in the electroplating liquid throughout the electroplating operation. When an inside peripheral surface of a metal cylinder is electroplated with the composite electroplating liquid, it is difficult to flow the composite electroplating liquid at a uniform and constant flow rate, while maintaining a uniform distribution of the fine solid particles in the composite electroplating liquid. Therefore, it is difficult to uniformly distribute a desired amount of the fine solid particles in the resultant composite electroplating layer.

Where a composite electroplating is applied to a portion of a metal material surface, for example, an inside peripheral surface of a metal cylinder, Japanese Unexamined Patent Publication (Kokai) No. 52-93,636 teaches a process in which a composite electroplating liquid is introduced into a bottom portion of the cylinder, flows upward through the hollow space of the cylinder and then is overflowed from the top portion of the cylinder. This method is the so-called an upflow method. This method is, however, disadvantageous for the following reasons.

In this upflow method, since an anode is placed in the hollow space of the cylinder, the stream of the composite electroplating liquid flowing through the hollow space of the cylinder in an upward direction is obstructed by the anode, and local differential flow rates are produced in the stream. These local differential flow rates cause the fine solid particles dispersed in the composite electroplating liquid stream to be unevenly distributed. Therefore, in the resultant composite electroplating layer formed on the inside peripheral surface of the cylinder, the fine solid particles are unevenly distributed.

Generally, to form a composite electroplating layer having a uniform distribution of the fine solid particles on a metal material surface by the upflow method, it is required that (1) the flow condition of the composite electroplating liquid is maintained uniform and (2) the fine solid particles dispersed in the composite electroplating liquid are brought in a uniform distribution thereof toward the surface of the metal material to be plated and fixed on the surface.

Nevertheless, in the conventional composite electroplating methods and the conventional productions of composite electroplated metal materials, have not yet succeeded in satisfing the above-mentioned two requirements.

SUMMARY OF THE INVENTION

An object of the present invention is to provide a process and apparatus for composite electroplating a metal material by using a composite electroplating liquid containing metal ions and fine solid particles dispersed in the liquid, to form a composite electroplating layer comprising the fine solid particles substantially uniformly distributed in a metal matrix, on a surface of the metal material.

Another object of the present invention is to provide a process and apparatus for composite electroplating a metal material by bringing a composite electroplating liquid containing metal ions and fine solid particles under a uniform flow condition into contact with a surface of the metal material and thereby moving the fine solid particles toward the surface of the metal material and being fixed on the metal material surface, while maintaining the distribution of the fine solid particles in the composite electroplating liquid uniform.

The inventors of the present invention found that the above-mentioned objects can be attained by forming a portion of a side wall of an electroplating liquid container of a metal material which serves as an electrode; and by introducing a composite electroplating liquid into a bottom portion of the container in such a manner that the introduced composite electroplating liquid spouts downward against an inside bottom surface of the container and then is allowed to flow upward through a path formed between an inside peripheral surface of the container and an opposite electrode placed in the container.

The process of the present invention for composite electroplating a metal material comprises the steps of:

preparing a composite electroplating liquid containing ions of at least one metal and fine solid particles dispersed in the liquid;

introducing the composite electroplating liquid into an electroplating system comprising a container having a bottom and a side wall extending upward from the bottom, at least a portion of the inside surface of the side wall of the container being formed from a metal material and serving as an electrode, and an opposite electrode formed from a metal material, placed in the container and facing the electrode, in such a manner that the introduced composite electroplating liquid spouts downward against the inside bottom surface of the container;

flowing upward the spouted composite electroplating liquid through an upward flowing path formed between the electrode and the opposite electrode; and applying an electric current between the electrode and the opposite electrode, to form a composite plating layer comprising a metal matrix and the fine solid particles uniformly dispersed in the metal matrix on a surface of one of the electrodes and the opposite electrode.

The apparatus of the present invention for composite electroplating a metal material comprises:

a container provided with a bottom and a side wall extending upward from the bottom, at least a portion of an inside surface of the side wall of the container being formed from a metal material and serving as an electrode;

means for spouting a composite electroplating liquid containing ions of at least one metal and fine solid particles dispersed in the liquid, connected to a supply source of the composite electroplating liquid arranged in the container, and having a liquid-spouting opening facing downward towards the inside surface of the bottom of the container;

an opposite electrode formed from a metal material, arranged in the container, and facing the electrode, and means for applying an electric current between the electrode and the opposite electrode, an upward flowing path being formed between the electrode and the opposite electrode, whereby the composite electroplating liquid spouted through the spouting opening is allowed to flow upward therethrough.

In an embodiment of the process apparatus of the present invention, the electrode formed in the side wall of the container is a cathode, the opposite electrode placed in the container is an anode, and the composite electroplating layer is formed on the cathode surface.

In another embodiment of the process and apparatus of the present invention, the electrode formed in the side wall of the container is a cathode in the form of a cylinder, and the composite electroplating layer is formed on the inside surface of the cylindrical cathode.

In a still another embodiment of the present invention, the electrode formed in the side wall of the container is an anode, the opposite electrode placed in the container is a cathode, and the composite electroplating layer is formed on the cathode surface.

DESCRIPTION OF THE PREFERRED EMBODIMENTS

Figure 1:
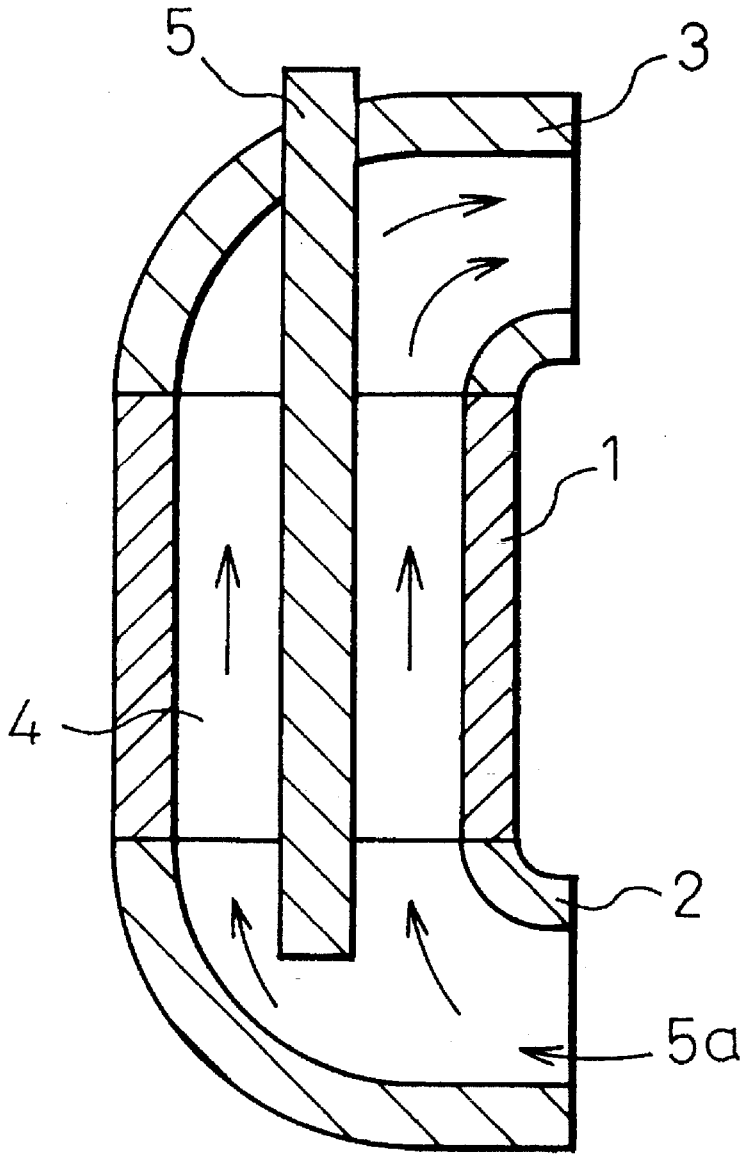
Fig.1 PRIOR ART
FIG. 1 is a cross-sectional front view of a conventional apparatus for composite electroplating an inside surface of a cylindrical metal material by a composite electroplating liquid containing metal ions and fine solid particles.

FIG. 1 shows an explanatory cross-sectional front view of a conventional upflow type electroplating apparatus and illustrates a conventional process for electroplating a metal material by using this conventional apparatus.

In FIG. 1, a cylindrical metal material 1 to be electroplated is stood vertically, a curved non-electroconductive bottom pipe 2 is attached to a bottom end of the cylindrical metal material 1, and a curved non-electroconductive top pipe 3 is attached to a top end of the cylindrical material 1 so as to form a curved path 4 for flowing upward an electroplating liquid through the curved bottom pipe 2 the vertical cylindrical metal material 1 and the curved top pipe 3 connected to each other. The cylindrical metal material 1 serves as an electrode, namely, a cathode or anode. Into the electroplating liquid path 4, an opposite electrode 5 against the electrode 4 is inserted. Usually, the opposite electrode is in the form of a circular rod. In this case, the electroplating liquid path 4 defined by the inside peripheral surface of the cylindrical metal material (electrode) 1 and the outside peripheral surface of the opposite electrode 5 is in the form of a cylinder or annulus.

In an electroplating process using the apparatus of FIG. 1, a composite electroplating liquid **5*a* containing metal ions and fine solid particles is introduced under pressure into the curved bottom pipe 2, flowed upward through the cylindrical electrode 1 and overflowed from the curved top pipe 3. This composite electroplating liquid 5*a* is continuously circulated through the path 4**.

When the electrode 1 is a cathode, the opposite electrode 5 is an anode, and an electric current is applied between the cathode 1 and the anode 5, a composite electroplating layer comprising a metal matrix and fine solid particles dispersed in the metal matrix are formed on the inside peripheral surface of the cylindrical cathode 1.

The composite electroplating process and apparatus shown in FIG. 1 are disadvantageous in that since the stream of composite electroplating liquid **5*a* introduced into the curved bottom pipe 2 and flowing through the hollow space of the cylindrical electrode 1 becomes nonuniform in the flow rate and flow direction due to difference in length of flow path in the curved portion of the bottom pipe 2 between a curved inside portion and a curved outside portion of the flow path divided by the opposite electrode 5 and due to obstruction of the flow by the opposite electrode 5. This phenomenon causes the distribution of the fine solid particles in the composite electroplating liquid 5*a* flowing through the hollow space of the cylindrical electrode 1 to be ununiform. Therefore, the distribution of the fine solid particles in the resultant composite electroplating layer formed on the inside peripheral surface of the cylindrical electrode 1 becomes ununiform. Also, it happens that due to differences in flow rate and flow direction of the composite electroplating liquid 5*a*, a portion of the fine solid particles in the composite electroplating liquid 5*a*** precipitates downward and thus the fine solid particles are contained in a reduced content or nonuniformly distributed in the resultant composite electroplating layer.

The above-mentioned disadvantages of the conventional composite electroplating process and apparatus are removed by the process and apparatus of the present invention.

Figure 2:
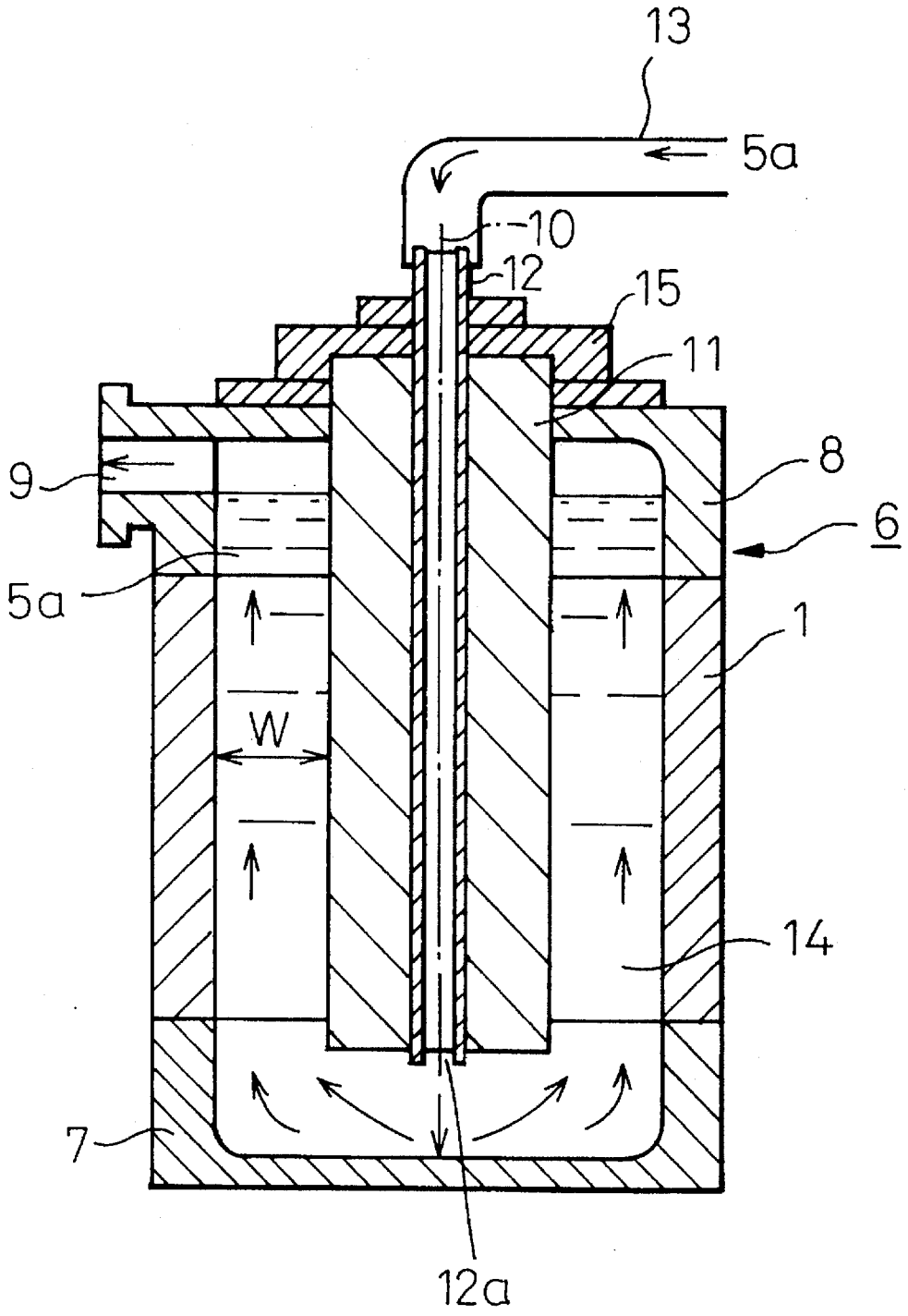
FIG. 2 is a cross-sectional front view of an embodiment of the apparatus of the present invention for composite electroplating an inside surface of a cylindrical metal material by a composite electroplating liquid containing metal ions and fine solid particles.

FIG. 2 shows an explanatory cross-sectional front view of an embodiment of the composite electroplating apparatus and illustrates an embodiment of the process of the present invention using the apparatus.

In FIG. 2, a container 6 comprises a vertical cylindrical metal material 1 which serves as an electrode, a bottom member 7 connected to the lower end of the cylindrical electrode 1, a cover member 8 connected to the top end of the cylindrical electrode 1. The bottom member 7 and cover member 8 are made from a non-electroconductive material, for example, a ceramic material or polymeric material. The cover member 8 is provided with an overflow opening 9.

In the container 6, an opposite electrode 11 is inserted along a vertical axis of the container 6.

The apparatus of the present invention has means for spouting a composite electroplating liquid containing ions of at least one metal and fine solid particles dispersed in the liquid into the container. This spouting means is connected to a supply source of the composite electroplating liquid, arranged in the container, and has a liquid-spouting opening facing downward the inside surface of the bottom of the container.

In the apparatus of FIG. 2, the liquid-spouting means comprises an inlet pipe 12 for spouting downward the composite electroplating liquid through a lower end opening. The inlet pipe 12 is arranged along the vertical axis of the opposite electrode 11.

The lower end 12*a* of the inlet pipe 12 opens downward, towards the inside bottom surface of the container 6, and serves as an inlet for spouting the composite electroplating liquid into the container 6.

A top end of the inlet pipe 12 is connected to a supply source (not shown in FIG. 2) of the composite electroplating liquid through a composite electroplating liquid-feed pipe 13. The opposite electrode 11 is in the form of a cylinder having a hollow space for receiving the inlet pipe 12 for spouting the composite electroplating liquid.

In the apparatus of FIG. 2, an annular or cylindrical path 14 for flowing the composite electroplating liquid therethrough is formed between the inside peripheral surface of the cylindrical electrode 1 and the outside peripheral surface of the opposite electrode 11. Also, a combination of the opposite electrode 11 and the pipe 12 is fixed to the cover member 8 by a fixing member 15.

Referring to FIG. 2, a composite electroplating liquid 5*a* containing metal ions and fine solid particles is introduced downward under pressure from the composite electroplating liquid-feed source (not shown) into a bottom portion of the container 6 through a feed pipe 13 and an inlet pipe 12. A stream of the introduced composite electroplating liquid 5*a* is spouted downward against the inside bottom surface of the container 6, and generates turbulent flows so as to cause the fine solid particles to be uniformly dispersed and distributed in the composite electroplating liquid stream.

The composite electroplating liquid 5*a* containing the uniformly distributed fine solid particles flows upward through the annular or cylindrical flow path 14. This upward flow of the composite electroplating liquid 5*a* forms in a uniform parallel stream and thus no nonuniformity in distribution of the fine solid particles is generated in the upward stream of the composite electroplating liquid 5*a*.

The inside peripheral surface of the cylindrical electrode 1 contacts the upward stream of the composite electroplating liquid 5*a*. When the cylindrical electrode 1 is a cathode and the opposite electrode 11 is an anode, and an electric current is applied between the cathode 1 and the anode 11, a composite electroplating layer is formed on the inside peripheral surface of the cathode 1. In this composite electroplating layer, the fine solid particles are uniformly distributed in a desired amount in a metal matrix derived from the metal ions.

When the upward stream of the composite electroplating liquid reaches a level of the overflow opening 9, it overflows to the outside of the container 6 through the overflow opening 9 and is recycled to the feed source thereof (not shown). In this feed source, the composition of the composite electroplating liquid is adjusted to a desired composition, and the adjusted composite electroplating liquid is re-circulated through the container 6, and re-used to composite electroplate the cathode 1.

In the process and apparatus as shown in FIG. 2, the metal material for the electrode 1 is not limited to those having a specific form, specific dimensions and specific structure, as far as the electrode 1 can be uniformly composite electroplated. For example, in FIG. 2, the combination of the vertical cylindrical electrode 1 and the bottom member 7 may be replaced by a cup-shaped member or a bottom-closed cylindrical member made of an electroconductive metal material.

Also, in FIG. 2, the opposite electrode 11 may contain only one inlet pipe 12 or a plurality of inlet pipes for introducing the composite electroplating liquid into the container 6.

Further, the electrode 1 to be contained in the container 6 is not limited to the cylindrical one or the cup-shaped one, and may be one having a curved inside peripheral surface conforming to a portion of the inside peripheral surface of the container 6.

The electrode 1 can be connected in a liquid-tight way to the bottom member 7 and/or the cover member 8 through an adhesive (not shown), or through a packing member (not shown) under pressure. Otherwise, a combination of these members may be packed in a liquid tight way in a sheath container.

The metal material for the electrode or the opposite electrode to be composite electroplated by the process and apparatus of the present invention is not limited to a specific group of metal materials. Preferably, the metal material is selected from shaped materials of at least one member selected from iron, iron alloys, aluminum, aluminum alloys, titanium, titanium alloys, copper, copper alloys, chromium, chromium alloys, tin, tin alloys, cobalt, cobalt alloys, zinc and zinc alloys. The iron alloys include, for example, S 25 C, SS 41 and SUS 630, the aluminum alloys include, for example, A 4032, AC 4 B and A 1070, and the titanium alloys include, for example, 6AL-4V.

The metal ions contained in the composite electroplating liquid are not limited to a specific group of metal ions. Preferably, the metal ions are selected from ions of nickel, chromium, cobalt, copper, iron, zinc, tin and tungsten. The metal ions form a metal matrix consisting of a single metal or an alloy. Namely, the metal matrix preferably comprises a metal selected from the group consisting of nickel, chromium, cobalt, copper, iron, zinc, tin, tungsten and alloys of one of these metals with at least one member selected from the group consisting of other metals than the above-mentioned one metal, phosphorus, boron and carbon.

The type, size and structure of the fine solid particles contained in the composite electroplating liquid are not specifically limited. Preferably, the fine solid particles are selected from the group consisting of fine particles of SiC, BN, $Si_3N_4$, WC, TiC, $TiO_2$, $Al_2O_3$, $ZnB_3$, diamond, CrC, $MoS_2$, coloring materials, polytetrafluoroethylene, and microcapsules each comprising a core consisting of a lubricant and a shell surrounding the core. The content of the fine solid particles in the composite electroplating liquid is not limited to a specific range thereof, and may be established in consideration of the desired content of the fine solid particles in the resultant composite electroplating layer and the composition of the composite electroplating liquid.

Preferably, the fine solid particles have a size of 0.1 to 50 μm, more preferably 0.3 to 10 μm.

In the process and apparatus of the present invention, an electric current is applied between the electrode and the opposite electrode to composite electroplating a surface of the electrode or the opposite electrode. The composite electroplating conditions are not specifically limited. Generally, to adjust the thickness of the resultant composite electroplating layer with a high level of uniformity, the electric current density is preferably controlled in the range of 1 to 25 $A/dm^2$. If the electric current density is less than 1 $A/dm^2$, sometimes the electroplating efficiency becomes unsatisfactory. Also, if the electric current density is more than 25 $A/dm^3$, sometimes irregular projections are formed on edge portions of the composite electroplating layer.

In the process and apparatus of the present invention, the flow speed of the composite electroplating liquid through the upward flow path is appropriately established in consideration of the composition of the composite electroplating liquid and the type and structure of the composite electroplating apparatus. Generally, the upward flow speed of the composite electroplating liquid through the upward flow path is preferably in the range of 2.5 to 30 cm/sec, more preferably 6.0 to 15.0 cm/sec. If the upward flow speed is less than 2.5 cm/sec, sometimes the flow movement of the composite electroplating liquid on the surface of the electrode or the opposite electrode to be composite electroplated is too weak and thus the surface of the resultant composite electroplating layer becomes uneven. Also, if the upward flow speed is more than 30 cm/sec, sometimes the movement speed of the fine solid particles becomes too high, and thus the content of the fine solid particles in the resultant composite electroplating layer does not reach a desired level.

Referring to FIG. 2, in the process and apparatus of the present invention, the width W of the upward flow path 14 for the composite electroplating liquid is appropriately established in consideration of the flow speed and the flow rate of the composite electroplating liquid flowing therethrough and the form and dimensions of the surface to be composite electroplated. Generally, the width W of the upward flow path 14 is preferably in the range of 5 to 400 mm, more preferably 20 to 50 mm. If the width W is too small, sometimes the flow speed of the composite electroplating liquid through the upward flow path becomes too high, and thus the content of the fine solid particles in the resultant composite electroplating layer does not reach a desired level. Also, if the width W is too large, sometimes, the flow speed of the composite electroplating liquid through the upward flow path becomes too low, and thus the fine solid particles in the composite electroplating liquid precipitate.

Figure 3:
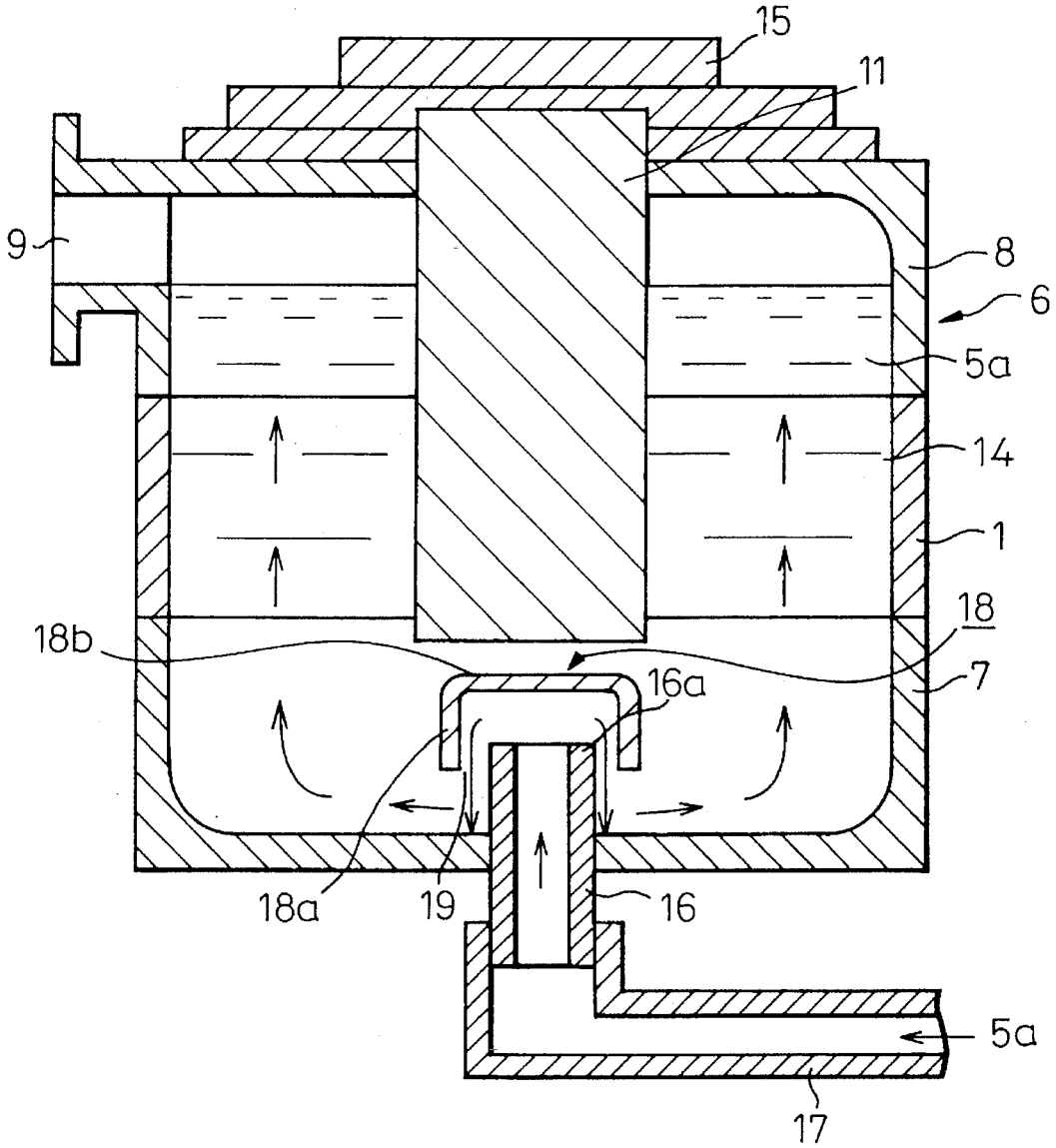
FIG. 3 is a cross-sectional front view of another embodiment of the apparatus of the present invention for composite electroplating an inside surface of a cylindrical metal material by a composite electroplating liquid containing metal ions and fine solid particles.

Another embodiment of the process and apparatus of the present invention is shown in FIG. 3. In FIG. 3, the liquid-spouting means comprises an inlet pipe 16 and a repulsing member 18. The inlet pipe 16 for introducing the composite electroplating liquid 5*a* is inserted along the vertical axis of the container 6 into a bottom portion of the container 6 through the bottom of the bottom member 7 of the container 6. The lower end of the inlet pipe 16 is connected to a supply source (not shown) of the composite electroplating liquid 5*a* through a feed pipe 17 for the liquid 5*a*.

An upper end 16*a* of the inlet pipe 16 opens upward in the bottom portion of the container 6. The repulsing member 18, which is preferably in the form of a parasol having an edge portion 18*a* extending downward, from a top portion 18*b* thereof, is arranged above and spaced from the upper end opening 16*a* of the inlet pipe 16 to form a gap 19 between the upper end portion of the inlet pipe 16 and the repulsing member 18 (especially the downwardly extending edge portion 18*a* thereof). The gap 19 opens downward and faces the inside face of the bottom of the container 6.

In the embodiment of the process of the present invention using the apparatus of FIG. 3, the composite electroplating liquid 5*a* is introduced upward from the supply source thereof (not shown) into the central bottom portion of the container 6 through the feed pipe 17 and the inlet pipe 16. The flow direction of the introduced composite electroplating liquid 5*a* is turned at an angle of substantially 180 degrees in the flow path formed between the upper end opening 16*a* of the inlet pipe 16 and the parasol-shaped repulsing member 18*a* by the guide of the lower surface of the repulsing member 18. Then the composite electroplating liquid is spouted downwards against the inside surface of the bottom of the container 6 through the gap 19. In the spouted composite electroplating liquid, a plurality of turbulent flows are generated so that the fine solid particles are uniformly dispersed and distributed in the composite electroplating liquid. The spouted composite electroplating liquid flows upward through an upward flow path 14 formed between the inside wall surface of the container 6 and the opposite electrode 11, reaches the level of the overflow opening 9 and then overflows to the outside of the container through the overflow opening 9. In this process, the upward stream of the composite electroplating liquid in the upward flow path is in the state of a parallel flow, and the fine solid particles are uniformly distributed. By applying an electric current between the electrode and the opposite electrode, a surface of the electrode or the opposite electrode is uniformly electroplated with a composite electroplating layer.

In the apparatus of FIG. 3, the cylindrical electrode 1 preferably serves as a cathode and thus is electroplated with the composite electroplating layer in which the fine solid particles are evenly distributed in a desired content. The opposite electrode 11 serves as an anode.

In FIGS. 2 and 3, at least a portion of the inside surface of the container 6 is formed from a metal material 1 and preferably serves as a cathode, and the opposite electrode 11 preferably serves as an anode.

In another embodiment of the process and apparatus of the present invention, at least a portion of the inside surface of the container 6 serves as an anode, and the opposite electrode serves as a cathode which is made from a metal material.

Figure 4:
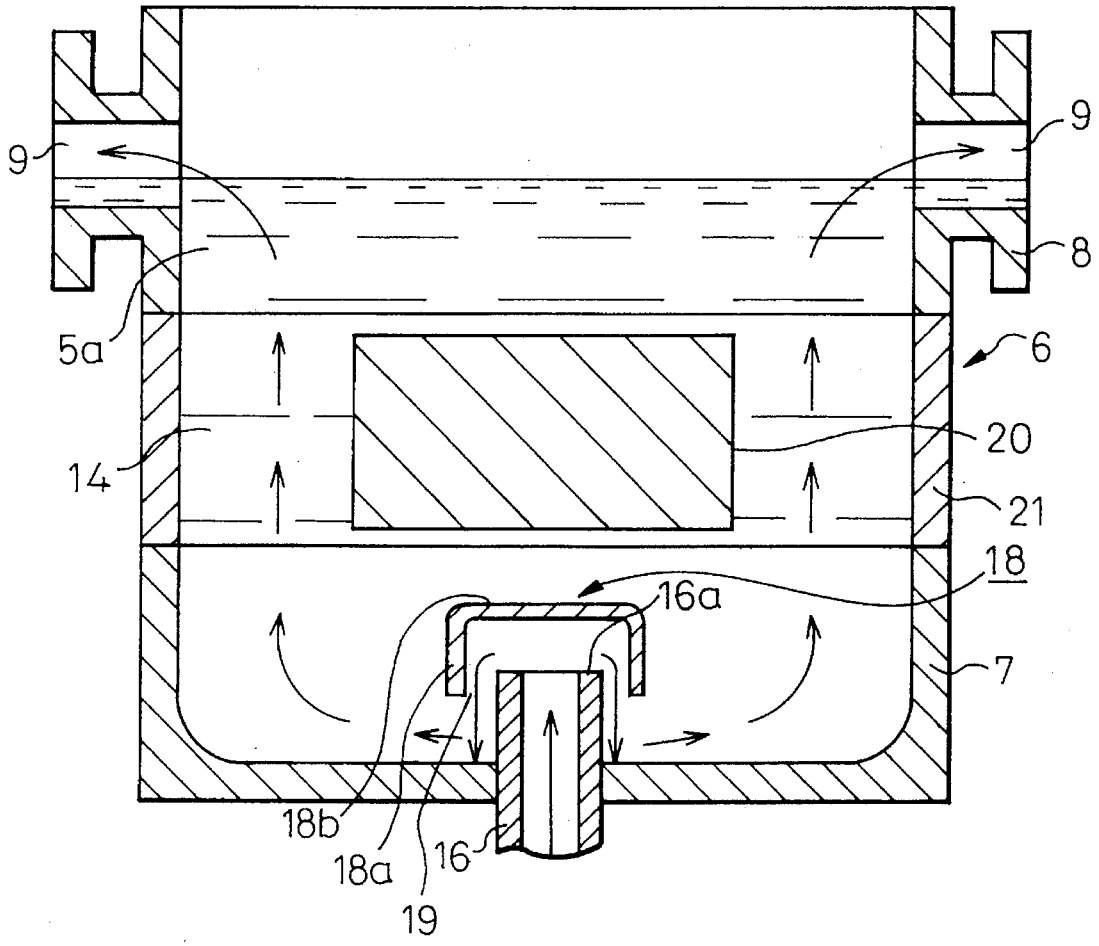
FIG. 4 is a cross-sectional front view of still another embodiment of the apparatus of the present invention for composite electroplating an outside surface of a metal material by a composite electroplating liquid containing metal ions and fine solid particles.

For example, in FIG. 4, a cathode 20 consisting of a metal material to be composite electroplated is placed in the container 6 and a portion 21 of the side wall of the container 6 facing the cathode 20 serves as an anode. In the apparatus of the FIG. 4, the liquid spouting means arranged in the bottom portion of the container 6 is the same as in FIG. 3 and comprises an inlet pipe 16 and a parasol-shaped repulsing member 18.

Also, in the apparatus of FIG. 4, a pair of overflow openings 9 are formed in the top portion of the container 6. The overflow openings 9 may be arranged in the number of 3 or more.

In the process of the present invention using the apparatus of FIG. 4, the composite electroplating liquid is introduced from a supply source (not shown) thereof through a feed pipe (not shown) and the inlet pipe 16 upwardly into a bottom center portion of the container 6, turned in the flow direction thereof through a flow path formed between an upper end portion of the inlet pipe 16 and the parasol-shaped repulsing member 18, at an angle of substantially 180 degrees, then is spouted downward against the inside bottom surface of the container through a gap 19 formed between the upper end portion 16*a* of the inlet pipe 16 and the edge portion 18*a* of the repulsing member 18. In the spouted composite electroplating liquid, a plurality of turbulent flows are generated so as to uniformly distribute the fine solid particles in the liquid. Then, the spouted composite electroplating liquid flows upward through a flow path 14 formed between the inside wall surface of the container 6 and the outside surface of the cathode 20. By applying an electric current between the cathode 20 made from a metal material and the anode 21, the outside surface of the metal material of the cathode 20 is uniformly electroplated with a composite electroplating layer. The upward stream of the composite electroplating liquid reaches the level of the overflow openings 9 and is overflowed through the overflow openings. In the process and apparatus of the present invention, the composite electroplating liquid is recycled through the supply source and the container and re-used for the composite electroplating.

The present invention will be further explained by the following specific examples.

EXAMPLE 1

A fine SiC particle-containing nickel-electroplating layer was formed on an inside peripheral surface of an aluminum cylinder by using the apparatus indicated in FIG. 2 and by the following procedures.

(1) Metal Material to be Plated

An aluminum cylinder consisting of JIS A 6063 TD, and having an inside diameter of 90 mm, an outside diameter of 100 mm and a height (length) of 135 mm.

| (2) Container consisting of a hard polyvinyl chloride resin | |
|---|---|
| Bottom member | |
| Inside diameter: | 90 mm |
| Outside diameter: | 100 mm |
| Height: | 50 mm |
| Cover member | |
| Inside diameter: | 90 mm |
| Outside diameter: | 100 mm |
| Height: | 50 mm |
| Overflow opening | |

This opening was located at a height of 240 mm from the bottom of the container.

The container was prepared by bonding the lower end of the aluminum cylinder to the upper end of the bottom member, and the upper end of the aluminum cylinder to the lower end of the cover member.

The aluminum cylinder served as a cathode.

(3) Anode

This anode consisted of a titanium case containing nickel chips therein, and having an outside diameter of 40 mm and a length of 200 mm.

This anode was in the form of a cylinder having a hollow space with an inside diameter of 14 mm.

(4) Means for Spouting a Composite Electroplating Liquid

An inlet pipe made from a polyvinyl chloride resin and having a length of 230 mm, an outside diameter of 13 mm and an inside diameter of 9 mm was inserted into the hollow space of the anode. The anode with the inlet pipe was placed in the container and fixed to the cover member with a fixing member. The lower end of the inlet pipe opened toward the inside surface of the bottom of the container, and the upper end of the inlet pipe was connected to a supply tank of the composite electroplating liquid through a feed pipe.

| (5) Composition of composite electroplating aqueous liquid | |
|---|---|
| Component | Content |
| 60% by weight aqueous nickel sulfamate solution | 790 g/liter |
| Nickel chloride hexahydrate | 15 g/liter |
| Boric acid | 45 g/liter |
| Saccharin sodium salt | 5 g/liter |
| 50% by weight aqueous hypophosphorus acid | 0.6 g/liter |
| SiC particles (average size: 2.5 μm) | 100 g/liter |
| pH: 3.5–4.5 | |

(6) Temperature of Composite Electroplating Liquid

55° C. to 60° C.

(7) Electric Current Density

15 A/dm$^2$ (8) Electroplating Time 30 minutes (9) Flow Speed of Composite Electroplating Liquid Through Upward Flow Path 8 cm/sec.

(10) Tests

The following tests were carried out.

(a) Cross-Sectional Thickness of Composite Electroplating Layer

This thickness was measured by using a metallographic microscope at a magnification of 500.

(b) Content of Fine Solid Particles in Composite Electroplating Layer

The amount of Si in the composite electroplating layer was determined by using a SEM-EDS and then the content of SiC was calculated from the Si amount.

(c) Distribution Uniformity of Fine Solid Particles

With respect to each sample, 12 cross-sections of the electroplating layer were observed by a metallographic microscope at a magnification of 500, to evaluate the distribution uniformity of fine solid particles appearing in the cross-sections. The evaluation results were indicated as follows Good . . . The fine solid particles were substantially uniformly distributed Bad . . . The fine solid particles were nonuniformly distributed The test results are shown in Table 1.

EXAMPLE 2

The same SiC-containing nickel composite electroplating procedures as in Example 1 were carried out with the following exceptions.

In the liquid-spouting means, five polyvinyl chloride resin inlet pipes each having a length of 50 mm, an outside diameter of 4.5 mm and an inside diameter of 3.5 mm were inserted into the hollow space of the anode. These inlet pipes were connected to the composite electroplating liquid-supply tank through a single feed pipe.

The composite electroplating liquid flowed through the upward flow path at a flow speed of 15 cm/sec.

The test results are shown in Table 1.

EXAMPLE 3

The same composite electroplating procedures as in Example 1 were carried out with the following exceptions.

The fine SiC particles were replaced by 100 g/liter of fine $Si_3N_4$ particles having an average size of 1 μm.

The electroplating time was 40 minutes.

The test results are shown in Table 1.

COMPARATIVE EXAMPLE 1

The same composite electroplating procedures as in Example 1 were carried out except that the electroplating apparatus of FIG. 2 was replaced by a conventional apparatus as shown in FIG. 1.

The test results are shown in Table 1.

TABLE 1

| | Item | | |
|---|---|---|---|
| Example No. | Thickness of composite electroplating layer (μm) | Content of fine solid particles in composite electroplating layer (wt %) | Uniformity in distribution of fine solid particles in composite electroplating layer |
| Example | | | |
| 1 | 91 to 102 | 7.9 to 9.1 | Good |
| 2 | 90 to 103 | 8.0 to 9.3 | Good |
| 3 | 89 to 100 | 8.2 to 9.4 | Good |
| Comparative Example 1 | 86 to 106 | 7.0 to 102 | Bad |

As Table 1 clearly shows, in the process and apparatus of the present invention for composite electroplating a metal material surface by a composite electroplating liquid containing metal ions and fine solid particles, the fine solid particles are uniformly dispersed and evenly distributed in the composite electroplating liquid approaching the metal material surface and thus the resultant composite electroplating layer contains the fine solid particles uniformly distributed in, and fixed to a metal matrix.

The process and apparatus of the present invention are useful for an inside peripheral surface of a cylindrical metal material which is difficult to uniformly electroplate with a fine solid particle-containing electroplating layer by a conventional process and apparatus.

We claim:

1. A process for composite electroplating a metal material, comprising the steps of:

preparing a composite electroplating liquid containing ions of at least one metal and fine solid particles dispersed in the liquid;

introducing the composite electroplating liquid into an electroplating system comprising a container having a bottom having an inside surface and a side wall extending upward from the bottom, at least a portion of an inside surface of the side wall of the container being formed from a metal material and serving as a first electrode, and a second electrode formed from a metal material, placed in the container and facing the first electrode, in such a manner that the introduced composite electroplating liquid spouts downward against the inside bottom surface of the container;

flowing upward the spouted composite electroplating liquid through an upward flowing path formed between the first electrode and the second electrode; and applying an electric current between the first electrode and the second electrode, to form a composite plating layer comprising a metal matrix and the fine solid particles uniformly dispersed in the metal matrix on a surface of the first electrode or the second electrode.

2. The composite electroplating process as claimed in claim 1, wherein the first electrode formed in the side wall of the container is a cathode having an inside surface, the second electrode placed in the container is an anode, and the composite electroplating layer is formed on the cathode inside surface.

3. The composite electroplating process as claimed in claim 1, wherein the first electrode formed in the side wall of the container is a cathode in the form of a cylinder having an inside surface, and the composite electroplating layer is formed on the inside surface of the cylindrical cathode.

4. The composite electroplating process as claimed in claim 1, wherein the first electrode formed in the side wall of the container is an anode, the second electrode placed in the container is a cathode with an outer surface, and the composite electroplating layer is formed on the cathode outer surface.

5. The composite electroplating process as claimed in claim 1, wherein the metal material for the first electrode or the second electrode to be composite electroplated comprises at least one metal selected from the group consisting of iron, iron alloys, aluminum, aluminum alloys, titanium, titanium alloys, copper, copper alloys, chromium, chromium alloys, tin, tin alloys, cobalt, cobalt alloys, zinc and zinc alloys.

6. The composite electroplating process as claimed in claim 1, wherein the metal ions in the composite electroplating liquid are selected from ions of nickel, chromium, cobalt, copper, iron, zinc, and tin.

7. The composite electroplating process as claimed in claim 1, wherein the metal matrix comprises a metal selected from the group consisting of nickel, chromium, cobalt, copper, iron, zinc, tin, and tungsten; or a metal selected from the group consisting of nickel, chromium, cobalt, copper, iron, zinc, tin and tungsten, and at least one member selected from the group consisting of phosphorous, boron and carbon.

8. The composite electroplating process as claimed in claim 1, wherein the fine solid particles are selected from the group consisting of fine particles of SiC, BN, $Si_3N_4$, WC, TiC, $TiO_2$, $Al_2O_3$, $ZnB_3$, diamond and CrC, $MoS_2$, coloring materials, polytetra fluoroethylene and microcapsules each comprising a core consisting of a lubricant and a shell surrounding the core.

9. The composite electroplating process as claimed in claim 1, wherein the composite electroplating liquid flows at a flow speed of 2.5 to 30 cm/sec through the upward flowing path.

10. The composite electroplating process as claimed in claim 1, wherein the metal matrix comprises: an alloy of two or more metals selected from the group consisting of nickel, chromium, cobalt, copper, iron, zinc, tin and tungsten; or an alloy of two or more metals selected from the group consisting of nickel, chromium, cobalt, copper, iron, zinc, tin and tungsten, and at least one member selected from the group consisting of phosphorous, boron and carbon.

11. An apparatus for composite electroplating a metal material, comprising:

a container provided with a bottom having an inside surface and a side wall extending upward from the bottom, at least a portion of an inside surface of the side wall of the container being formed from a metal material and serving as a first electrode;

means for spouting a composite electroplating liquid, connected to a supply source of the composite electroplating liquid containing ions of at least one metal and fine solid particles dispersed in the liquid, comprising at least one inlet pipe inserted upward into the container through the bottom of the container along the vertical axis of the container and having an upper end opening thereof, and a repulsing member arranged above and spaced from the upper end opening of the inlet pipe to form a gap between the upper end portion of the pipe and the repulsing member, through which gap the composite electroplating liquid is spouted against the inside surface of the bottom of the container;

a second electrode formed from a metal material, arranged in the container, and facing the first electrode, and means for applying an electric current between the first electrode and the second electrode, an upward flowing path being formed between the first electrode and the second electrode, whereby the composite electroplating liquid spouted against the inside surface of the bottom of the container is allowed to flow upward therethrough.

12. The composite electroplating apparatus as claimed in claim 11, wherein the upward flowing path has a width of 5 to 400 mm.

13. An apparatus for composite electroplating a metal material, comprising:

a container provided with a bottom having an inside surface and a side wall extending upward from the bottom, at least a portion of an inside surface of the side wall of the container being formed from a metal material and serving as a first electrode;

means for spouting a composite electroplating liquid, connected to a supply source of the composite electroplating liquid containing ions of at least one metal and fine solid particles dispersed in the liquid, comprising at least one inlet pipe inserted upward into the container through the bottom of the container along the vertical axis of the container and having an upper end opening thereof, and a repulsing member arranged above and spaced from the upper end opening of the inlet pipe to form a gap between the upper end portion of the pipe and the repulsing member, through which gap the composite electroplating liquid is spouted against the inside surface of the bottom of the container;

a second electrode formed from a metal material, arranged in the container, and facing the first electrode, and means for applying an electric current between the first electrode and the second electrode, an upward flowing path having a width of 5 to 400 mm being formed between the first electrode and the second electrode, whereby the composite electroplating liquid spouted against the inside surface of the bottom of the container is allowed to flow upward therethrough.

* * * * *